US006261368B1

(12) United States Patent
Wight

(10) Patent No.: US 6,261,368 B1
(45) **Date of Patent: *Jul. 17, 2001**

(54) SHORT DWELL COATER WITH CROSS MACHINE DIRECTION PROFILING

(75) Inventor: E. William Wight, Roscoe, IL (US)

(73) Assignee: Beloit Technologies, Inc., Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/226,663

(22) Filed: Jan. 8, 1999

(51) Int. Cl.[7] ..... B05C 3/12
(52) U.S. Cl. ..... 118/410; 118/413; 118/419
(58) Field of Search ..... 118/665, 410, 118/413, 419; 427/356

(56) References Cited

U.S. PATENT DOCUMENTS

| | | | | |
|---|---|---|---|---|
| 4,245,582 | | 1/1981 | Alheid et al. | 118/119 |
| 4,357,370 | | 11/1982 | Alheid | 427/211 |
| 4,688,516 | | 8/1987 | Sommer | 118/410 |
| 4,793,899 | | 12/1988 | Skaugen | 162/381 |
| 4,869,933 | | 9/1989 | Sollinger et al. | 427/356 |
| 4,899,687 | * | 2/1990 | Sommer et al. | 118/126 |
| 4,957,770 | * | 9/1990 | Howarth | 427/9 |
| 4,961,968 | | 10/1990 | Shands et al. | 427/356 |
| 5,010,840 | | 4/1991 | Busker et al. | 118/421 |
| 5,192,591 | | 3/1993 | Chance | 427/356 |
| 5,199,991 | | 4/1993 | Chance | 118/410 |
| 5,383,968 | | 1/1995 | Rantanen et al. | 118/119 |
| 5,538,557 | | 7/1996 | Busker | 118/410 |
| 5,611,860 | | 3/1997 | Waech | 118/410 |
| 5,665,163 | | 9/1997 | Li et al. | 118/413 |
| 5,683,510 | | 11/1997 | Li et al. | 118/410 |

OTHER PUBLICATIONS

"Optiblade™—a new method for high–speed LWC coating," article by Jukka Linnonmaa and Martti Tyrväinen, 3 pages, *PaperNews,* published by Valmet Corporation, Helsinki, Finland.

"BA 1500™ Coater: Versatile, high speed blade applicator produces quality coated papers," a brochure published by Rader Companies, a Division of Beloit Corporation.

"New Coating Technologies Combine High Speeds with Higher Quality," an article publised in Pulp & Paper, by Andy Harrison, pp. 60–64. May 1994.

* cited by examiner

*Primary Examiner*—Laura Edwards
(74) *Attorney, Agent, or Firm*—Lathrop & Clark LLP

(57) ABSTRACT

Coating is applied from a coating application chamber to a moving web or backing roll by a rotating premetering rod, a curved or straight wedge, or a premetering blade which is urged against the moving substrate by a plurality of profiling mechanisms which are spaced from one another in the cross machine direction to control the cross machine direction profile of the applied coating to avoid coating streaks. The profiling mechanisms may be hydraulic actuators, machine screws or thermal expansion driven pistons. Cross machine profiling of the premetering device allows control with minimum pressure on the web. Adjustments to the premetering device are only made where necessary to correct nonuniform coating application where detected.

23 Claims, 5 Drawing Sheets

SHORT DWELL COATER WITH CROSS MACHINE DIRECTION PROFILING

FIELD OF THE INVENTION

The present invention relates to apparatus for applying coating to moving substrates such as paper, and applicator rolls in general, and to metering apparatus in particular.

BACKGROUND OF THE INVENTION

Paper with high quality finish may be created by applying a thin layer of coating material to one or both sides of the paper. The coating is typically a mixture of a fine plate-like mineral, typically clay or particulate calcium carbonate; coloring agents, typically titanium dioxide for a white sheet; and a binder of the organic type or of a synthetic composition. Rosin, gelatins, glues, starches or waxes may also be applied to paper for sizing.

Coated paper is typically used in magazines, commercial catalogs and advertising inserts in newspapers and other applications requiring good printing characteristics for color photos or other specialized paper qualities.

Various devices have been employed in the past to apply coatings to paper, either directly, by flooding the web as it passes through a pond, as in a short dwell coater, or by first applying the coating to a roll, as in a size press. Once coating has been applied to the substrate, it is necessary to meter the coating to a desired thickness and uniform level. Uneven coating thickness will produce blemishes and quality variances in the finished paper, and is highly undesirable.

The pond of coating material employed in the short dwell coater is formed by feeding an excess amount of coating material into a pond housing positioned beneath a backing roll over which a paper web is wrapped. The pond is caused to overflow in the up machine direction, thereby flooding the web and pre-wetting it as it approaches the pond. Downstream from the pond, a metering element, such as a blade, controls the amount of coating material that is applied to the web. The excess coating metered by the metering element is turned downwardly into the pond creating a recirculating zone between the down machine end of the pond and the coating feed at the up machine end of the pond where the excess coating overflows.

The trend in papermaking is to increase efficiency by increasing the speed of formation of the paper. Coating costs can be minimized by coating the paper while still on the papermaking machine. Increasing the paper web speed is critical to continued increases in papermaking productivity. But, because the paper is made at higher and higher speeds, and because of the advantages of on-machine coating, the coaters in turn must also run at high speeds. The need to produce lightweight coated paper to hold down the weight of the paper, and the costs of the coating material, makes the use of short dwell coaters more desirable, since, by subjecting the paper web to the coating material for a short period of time, the depth of penetration of the coating is limited, resulting in a lower coating weight.

However, the use of short dwell coaters at high machine speeds can lead to defects in the coating, typically coating streaks. As the speed of the machine increases, the fluid flow in the pond becomes chaotic and the recirculating flow forms a vortex. The result of the turbulent, chaotic flow is that the location where the paper becomes wetted by the coating begins to oscillate so uniformity of coating contact in the machine direction and the cross machine direction is lost. The turbulent flow which causes streaking in the coating is responsive to adjustments in the coater. Nonetheless, as machine speeds increase, greater control of coater parameters is required.

What is needed is a metering device which can be adjusted to overcome the problem of streaking caused by higher operating speeds.

SUMMARY OF THE INVENTION

The coaters of this invention employ one of three mechanisms. In one embodiment, a metering rod is disposed in front of a final metering blade. In another embodiment a curved or straight wedge is disposed in front of a final metering blade. In a further embodiment, a premetering blade is biased against a backing roll by a pneumatic tube located near the tip of the blade. The pneumatic tube holds the blade such that the flat of the blade is in contact with the film of coating being applied to the paper web. Each device for premetering the coating is mounted for adjustable movement toward and away from the backing roll over which a paper web is wrapped. Three mechanisms for moving the premetering devices are disclosed. Each mechanism is used as a series of like devices arrayed in the cross machine direction. The first mechanism is a hydraulic piston, the second mechanism is a machine screw, and the third mechanism is a thermal expansion driven piston. Cross machine profiling of the premetering device allows coating control with minimum pressure on the web. Adjustments to the premetering device are only made when necessary to correct detected streaking or to preferentially bias the coat weight.

It is a feature of the present invention to provide a short dwell coater which operates at higher speeds.

It is another feature of the present invention to provide a short dwell coater which can be profiled in the cross machine direction.

It is a further feature of the present invention to provide a short dwell coater which improves the hydrodynamics of the coating pond in the coater.

It is an additional feature of the present invention to provide a short dwell coater with an improved premetering device.

Further objectives, features and advantages of the invention will be apparent from the following detailed description when taken in conjunction with the accompanying drawings.

DESCRIPTION OF THE PREFERRED EMBODIMENT

Figure 1:
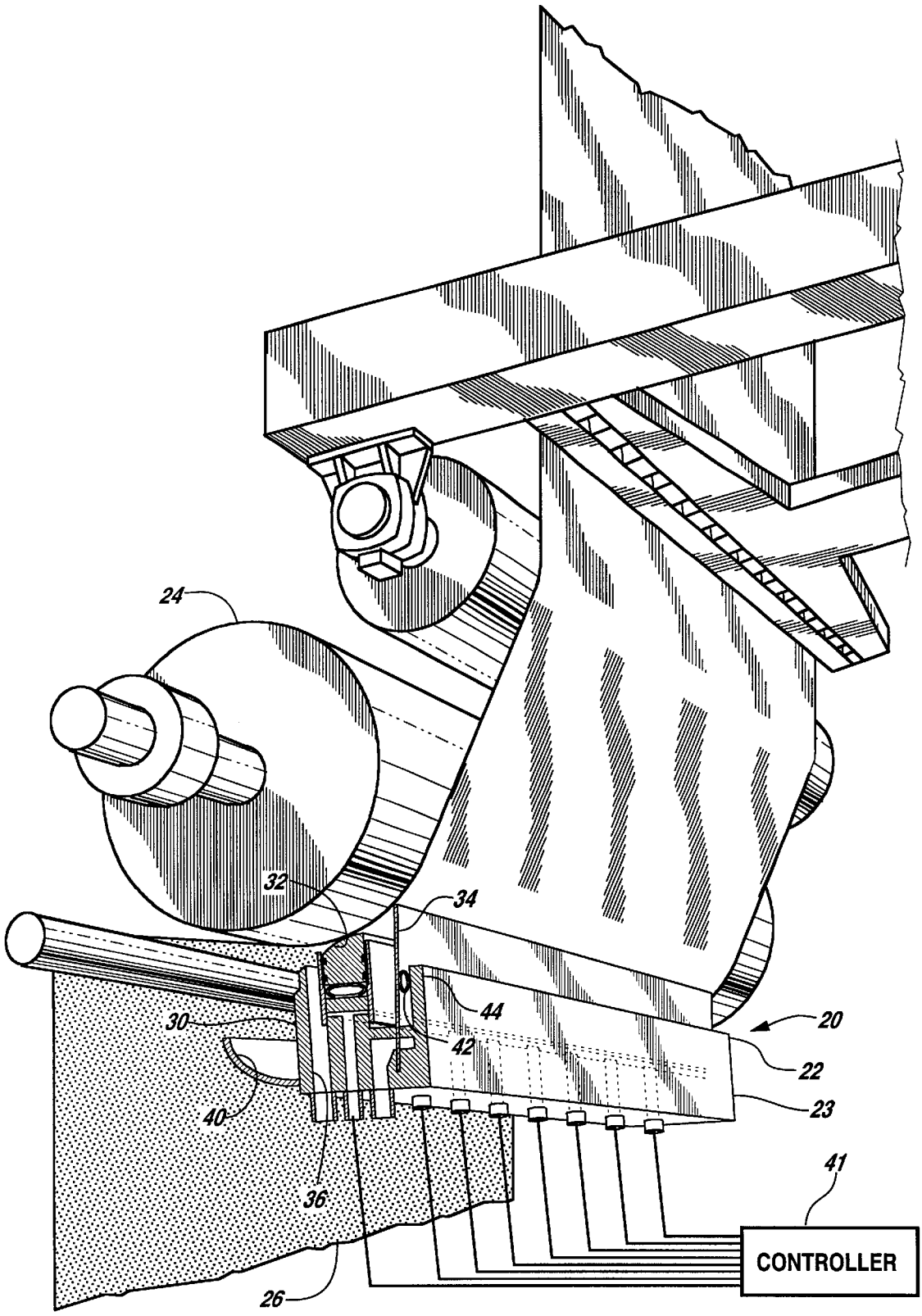
FIG. 1 is a perspective view of the short dwell coater of this invention as used to apply a coating to a web of paper on a backing roll.
Figure 2:
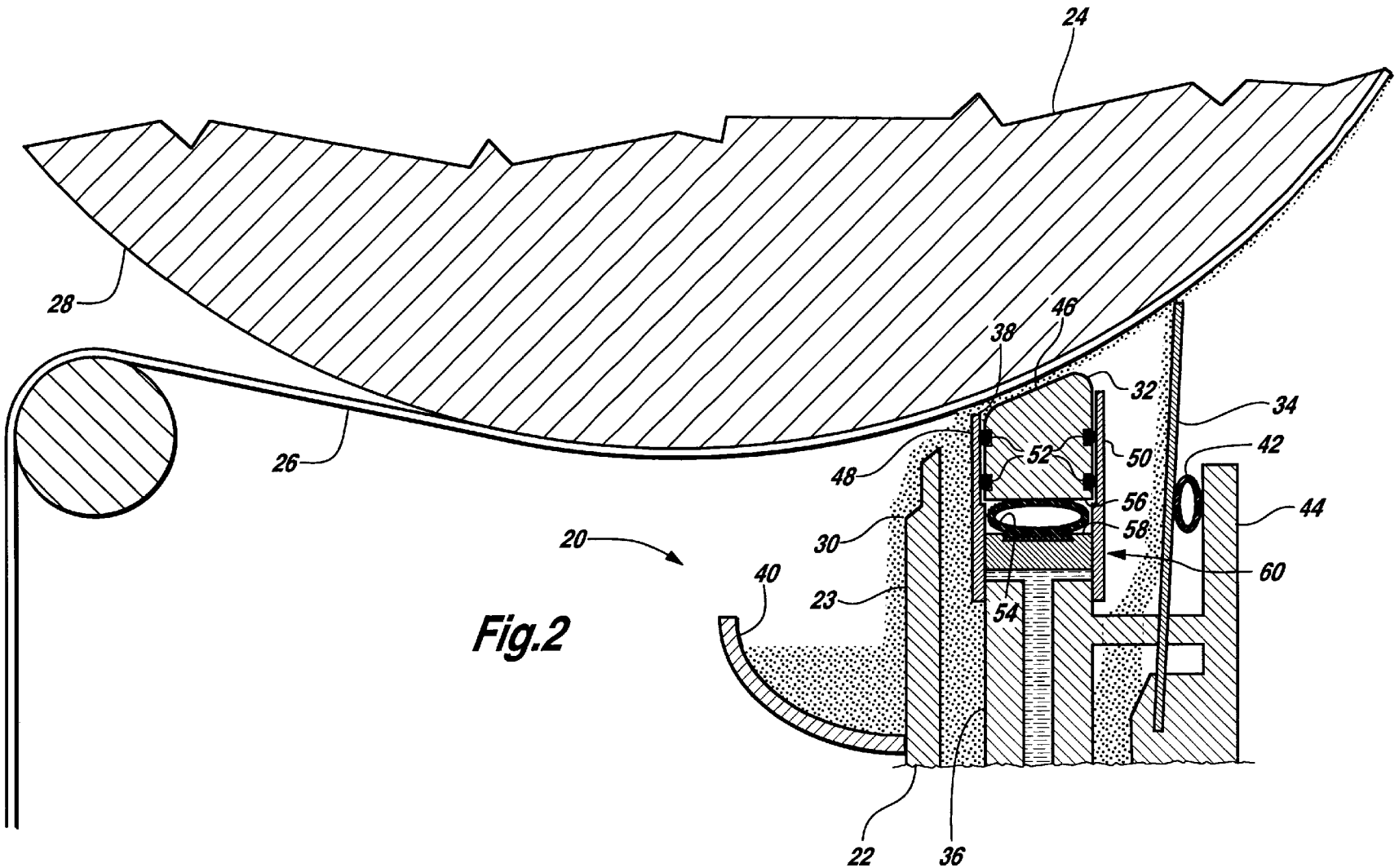
FIG. 2 is a cross-sectional view of the short dwell coater of FIG. 1.

Referring more particularly to FIGS. 1–7, wherein like numbers refer to similar parts a coater 20 is shown in FIGS.

1 and 2. The coater 20 has an applicator head 22 positioned beneath and next to a backing roll 24. A web of paper 26 is supported on the surface 28 of the roll 24. The applicator head 22 has a housing 23 with a baffle plate 30 which extends upstream of a premetering wedge 32 which is upstream of a final metering blade 34. Coating is supplied through a passageway 36 between the baffle plate 30 and the premetering wedge 32 to form a coating application chamber or pond 38. The coating overflows the upstream baffle plate 30 and is collected in a collector trough 40 from which the overflow coating is collected for cleaning and recycling. The coating overflow serves to remove air from the coating pond 38 and control the fluid dynamics within the pond 38.

The final metering blade 34 controls the thickness of the coating on the paper web 26. An inflatable pneumatic tube 42 is mounted to a support 44 which extends from the housing 23. The pneumatic tube 42 is engaged against the final metering blade 34. Inflation of the pneumatic tube 42 controls the amount of pressure with which the final metering blade 34 engages the web 26. By adjusting the pressure applied by the tube 42 to the final metering blade 34, the coating thickness may be controlled.

The premetering wedge 32 has a smooth upper surface 46 which engages the web 26 to define a converging wedge of coating. The premetering wedge 32 serves to control the formation of vortices within the pond 38. The wedge 32 is positioned between a front support 48 and a rear support 50. Sealing gaskets 52 prevent coating from passing between the wedge 32 and the front and rear supports 48, 50. A pneumatic tube 54 is positioned between the bottom 56 of the wedge 32 and a support piston 58. The pneumatic tube 54 provides support for the wedge 32 in the cross machine direction. A plurality of hydraulic actuators 60 provide cross machine profiling of the premetering wedge 32.

As machine speed is increased, flow instability can develop resulting in streaking of the coating on the web 26. To overcome the streaking produced by speed-induced instabilities within the coater 20, various parameters of the applicator head 22 can be adjusted. Some of the parameters which can be adjusted are the rate of flow of coating to the applicator head 22, the air pressure in the tube 54 which supports the premetering wedge 32, and the air pressure in the tube 42 which supports the final metering blade 34. Moreover, the distance between the upstream baffle plate 30 and the backing roll can be adjusted. However the adjustability of the foregoing parameters is limited by various runnability and maintenance and wear considerations. Placing the upstream baffle plate 30 too close to the backing roll can result in damage to the coater during a paper break. Increasing the pressure with which the premetering wedge 32 and the final metering blade 34 are pressed against the backing roll can result in excessive wear and increased stress on the web.

Cross machine profiling by adjusting the pressure on the premetering wedge 32 at discrete locations in the cross machine direction can overcome coat weight variation and streaking without affecting runnablity of the coater 20. A series of actuator mechanisms spaced from one another in the cross machine direction and independently controllable by the controller 41 provide an improved ability to overcome streaks in the coating.

Figure 5:
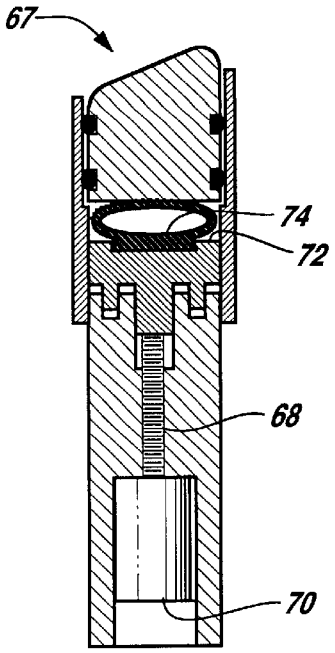
FIG. 5 is a cross-sectional view of a machine screw mechanism for moving a premetering device.

Three alternative embodiment actuator mechanisms which can be used to perform cross machine direction profiling of the premetering wedge 32 are shown in FIGS. 5∫7. A hydraulic system 61, shown in FIG. 6, has a hydraulic piston 62 which moves in a cylinder 63 which is supplied with hydraulic fluid by a supply passage 64. The piston 62 supports a pneumatic tube 66 which in turn supports a premetering wedge 65 such as the wedge 32 shown in FIG. 2. The hydraulic piston 62 may also support other premetering devices as discussed below.

A screw drive support system 67, shown in FIG. 5, has a machine screw 68 driven by a motor 70. The machine screw 68 supports a piston 72 on which is mounted a pneumatic tube 74. The piston tube arrangement can be used to support the premetering wedge 32 as well as other premetering devices as discussed below. The screw drive support system 67 is somewhat more complicated than a hydraulic support system. Nonetheless, the screw support system 67 advantageously requires no power to maintain a given profile and the profile is maintained when the machine is shut down.

Figure 6:
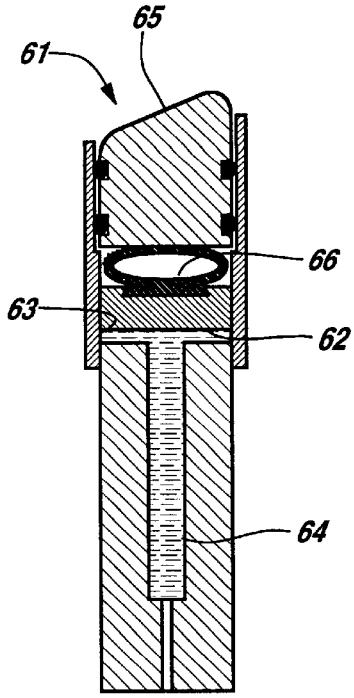
FIG. 6 is a cross-sectional view of a hydraulic mechanism for moving a premetering device.
Figure 7:
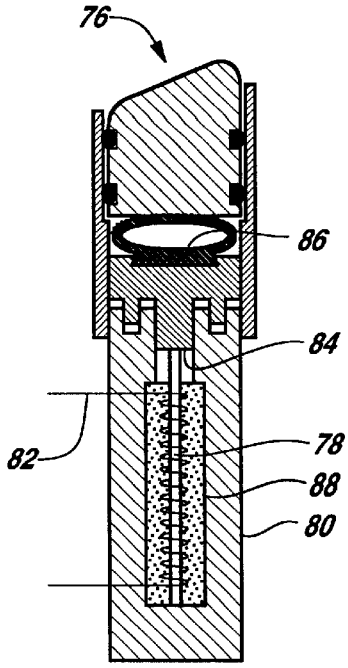
FIG. 7 is a cross-sectional view of a thermal expansion mechanism for moving a premetering device.

A differential thermal expansion profiling system 76 is shown in FIG. 7. Dissimilar metals expand at different rates when heated. This principal is typically used in thermostats where a lever arm composed of two dissimilar metals bends in response to the dissimilar expansion of the two metals and closes or opens a switch. The metal rod 78 may be composed of a metal with a high coefficient of thermal expansion, such as aluminum or magnesium, positioned in a cylinder 80 of low expansion metal such as molybdenum or chromium. A heater element 82 is positioned to heat the metal rod to cause the high expansion metal rod 78 to push against a piston 84. The piston 84, in a manner similar to the pistons of the mechanisms shown in FIGS. 5 and 6, supports a pneumatic tube 86 which in turn can support a premetering wedge 32 or other premetering device as discussed below. The rod 78 is insulated from the cylinder 80 by insulation 88. Insulation between the rod 78 and the cylinder 80 increases the effect of the differential expansion of the rod 78 and the cylinder 80. However it may be preferable to place the insulation external to the cylinder 80 so that the motion of the piston 84 is strictly controlled by temperature which is easily monitored and controlled.

Of course the principle of using dissimilar metals could be employed with various levers and mechanisms to amplify the force or the displacement produced by the differential expansion between two metals.

Figure 3:
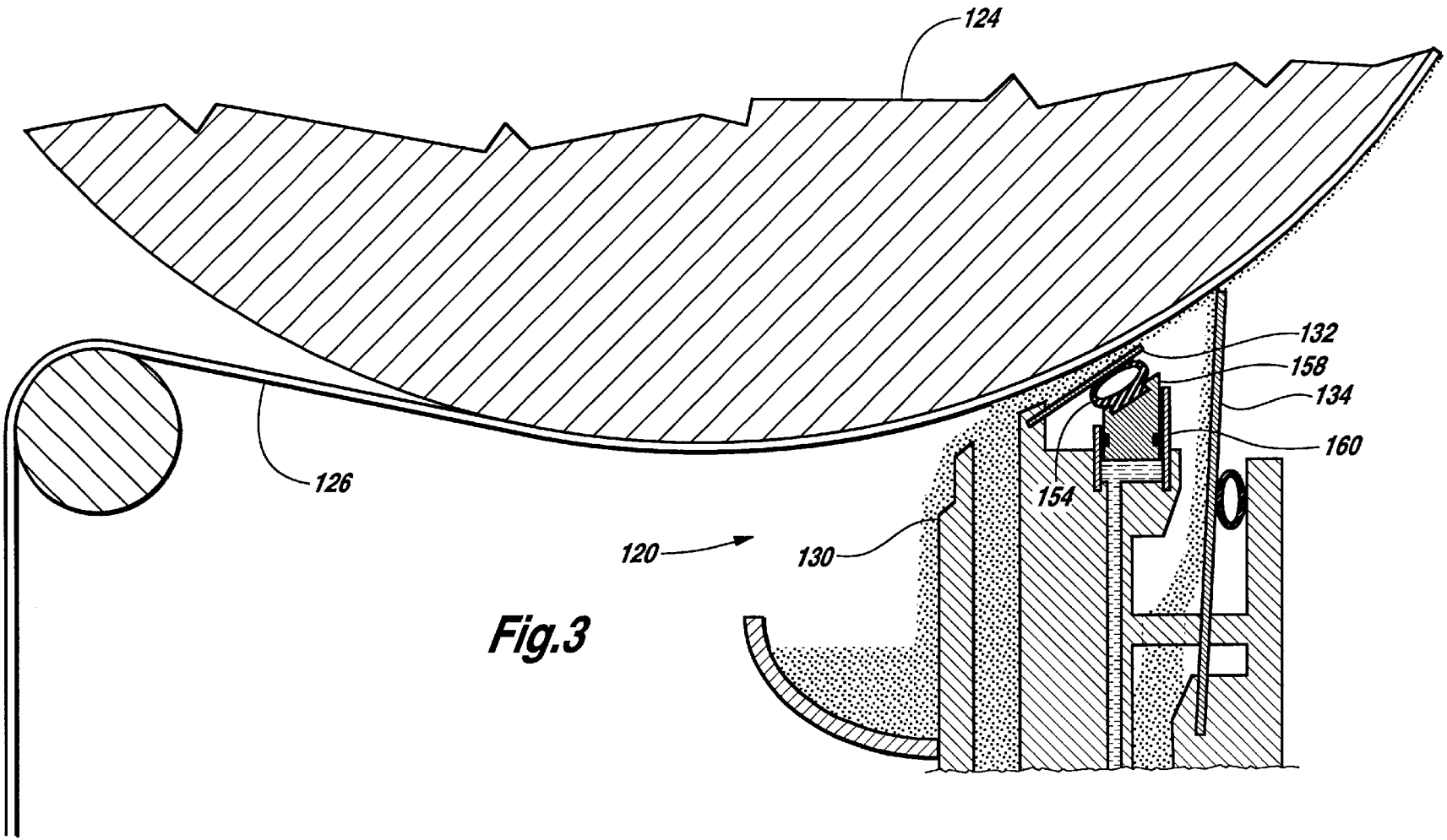
FIG. 3 is a cross-sectional view of an alternative embodiment short dwell coater of this invention.

The profiling mechanisms shown in FIGS. 5–7 can be used to introduce cross-machine profiling into a variety of applicator heads. An alternative embodiment coater 120, shown in FIG. 3, has an upstream baffle plate 130 which extends from the coater housing ahead of a final metering blade 134. A premetering blade 132 is positioned between the baffle plate 130 and the final metering blade 134. The premetering blade 132 is held in a rigid mount 146 and pressed tangentially against a paper web 126 supported by a backing roll 124. The premetering blade 132 is supported by a pneumatic tube 154 which is mounted to a piston 158 which moves toward and away from the backing roll within a hydraulic cylinder 160. The other mechanisms shown in FIGS. 5 and 7 could also be used to profile the premetering blade 132. It should be understood, that although only a single piston and cylinder mechanism is illustrated in FIG. 3, a plurality of profiling mechanisms will be disposed spaced from one another in the cross machine direction, all bearing on the pneumatic tube 154 and being controlled individually or in groups to adjust the pressure on the premetering blade 132 to thereby obtain uniformity of coating application.

Figure 4:
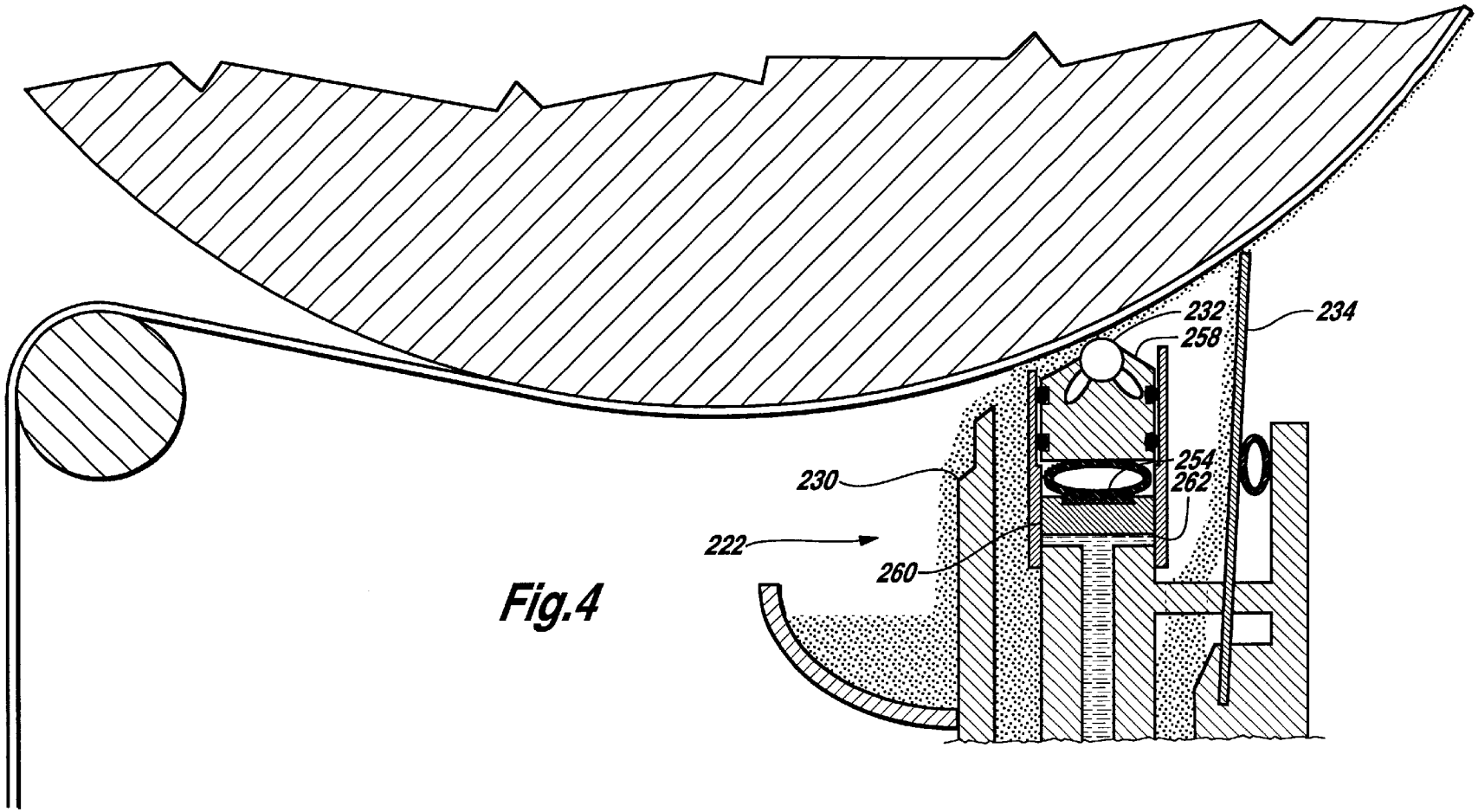
FIG. 4 is a cross-sectional view of a further alternative embodiment short dwell coater of this invention.

Another alternative embodiment applicator head 222 having a premetering rod 232 is shown in FIG. 4. The rod 232 is mounted in the applicator head 222 between an upstream baffle plate 230 and a final metering blade 234. The rod 232 is driven to rotate and thus perform the premetering function. The rod 232 rotates within a rod support fixture 258 which is displaced toward the backing roll by a pneumatic tube 254 which is supported by a plurality of hydraulic pistons 260 in hydraulic cylinders 262. Alternatively, the premetering rod 232 can be profiled in the cross machine direction by any of the mechanisms disclosed in FIGS. 5–7.

The spacing between profile actuators is typically three to four inches in a modern papermaking machine. However it should be understood that the distance between profiling actuators could be greater or less than three to four inches. FIG. 1 shows a plurality of hydraulic pistons arranged in the cross machine direction. Each piston is independently controlled so that the pressure on the premetering device can be varied in the cross machine direction to respond to the nonuniform coating weight detected in the web as it is formed.

It should be understood that the although the coaters of this invention have been illustrated for applying coatings directly to a substrate which is a moving web, they may also be employed in a size press for applying coating to a substrate which comprises a roll surface for transfer to a paper web.

It should also be understood that minimal or no profiling may also be performed if the uniformity of the coating application dictates. The premetering concepts described here improve the uniformity of the coating forces against the web and thus improve the coating application to the web compared to other arrangements.

It is understood that the invention is not limited to the particular construction and arrangement of parts herein illustrated and described, but embraces such modified forms thereof as come within the scope of the following claims.

We claim:

1. An apparatus for metering coating on a moving substrate comprising:

a backing roll which engages a substrate to be coated, the backing roll and the substrate extending in a cross machine direction;

a short dwell coater head housing positioned beneath the substrate and extending in the cross machine direction;

an upstream baffle plate, mounted on the short dwell coater head housing which extends from the housing toward the backing roll;

a means for premetering coating on the substrate, which is mounted on the short dwell coater head housing and which extends toward the backing roll from the housing, wherein the mean for premetering is spaced downstream from the baffle plate and a coating pond is formed between the means for premetering and the baffle plate, the means for premetering being supported for motion toward the substrate on an inflatable pneumatic tube;

a coating supply passageway between the upstream baffle plate and the means for premetering coating, for supplying coating to the coating pond;

a series of means for profiling in the cross machine direction mounted on the short dwell coater head housing and disposed beneath the means for premetering and the pneumatic tube, the means for profiling being spaced from one another in the cross machine direction;

a controller operatively connected to each of the series of means for profiling; and a final metering blade mounted on the short dwell coater head housing and positioned downstream of the premetering means and extending from the short dwell coater head housing toward the backing roll, the final metering blade engaging the substrate.

2. The apparatus of claim 1 wherein the means for premetering is a movable wedge with a smooth curved face disposed adjacent the substrate, the movable wedge being supported for motion toward the substrate on the inflatable pneumatic tube.

3. The apparatus of claim 1 wherein the means for premetering is a movable wedge with a smooth straight face disposed adjacent the substrate, the movable wedge being supported for motion toward the substrate on the inflatable pneumatic tube.

4. The apparatus of claim 1 wherein the means for premetering comprises:

a cylindrical rod engaged with the substrate; and a rod holder in which the cylindrical rod is supported for rotation, the rod holder being mounted on the inflatable pneumatic tube for motion toward the substrate.

5. The apparatus of claim 1 wherein the means for premetering is a blade oriented substantially tangent to the substrate and engaging the substrate at a line of tangency, and wherein the blade is urged against the substrate by the inflatable tube.

6. The apparatus of claim 1 wherein each means for profiling in the cross machine direction comprises a hydraulic piston positioned beneath the means for premetering.

7. The apparatus of claim 1 wherein each means for profiling in the cross machine direction comprises a machine screw which moves the means for premetering towards the substrate.

8. The apparatus of claim 1 wherein each means for profiling in the cross machine direction comprises a thermally expansible rod positioned beneath the means for premetering.

9. A coating applicator for applying a coating to a moving substrate, the applicator comprising:

a short dwell coater head housing positioned in proximity to and beneath a substrate, the housing extending in a cross machine direction;

an upstream baffle plate, mounted on the short dwell coater head housing which extends toward the substrate from the housing;

a means for premetering, mounted on the short dwell coater head housing and which extends toward the substrate from the housing, wherein the means for premetering is spaced downstream from the baffle plate and a coating application chamber is formed between the means for premetering and the baffle plate, the means for premetering being supported for motion toward the substrate on an inflatable pneumatic tube;

a coating supply passageway between the upstream baffle plate and the means for premetering coating, for supplying coating to the coating application chamber;

a series of means for profiling in the cross machine direction, mounted on the short dwell coater head housing which engage the means for premetering and the pneumatic tube, the means for profiling being spaced from one another in the cross machine direction;

a controller operatively connected to each of the series of means for profiling in the cross machine direction; and a final metering blade positioned downstream of the premetering means, the final metering blade extending from the short dwell coater head housing toward the substrate, the final metering blade engaging the moving substrate.

10. The apparatus of claim 9 wherein the means for premetering comprises a movable wedge with a smooth curved face disposed adjacent the moving substrate, the movable wedge being supported for motion toward the substrate on the inflatable pneumatic tube.

11. The apparatus of claim 9 wherein the means for premetering is a movable wedge with a smooth straight face disposed adjacent the moving substrate, the movable wedge being supported for motion toward the substrate on the inflatable pneumatic tube.

12. The apparatus of claim 9 wherein the means for premetering comprises:

a cylindrical rod engaged with the substrate; and a rod holder in which the cylindrical rod is supported for rotation, the rod holder being mounted on the inflatable pneumatic tube for motion toward the substrate.

13. The apparatus of claim 9 wherein the means for premetering is a blade oriented substantially tangent to the substrate and engaging the substrate at a line of tangency, and wherein the blade is urged against the substrate by the inflatable tube.

14. The apparatus of claim 9 wherein each means for profiling in the cross machine direction comprises a hydraulic piston positioned beneath the means for premetering.

15. The apparatus of claim 9 wherein each means for profiling in the cross machine direction comprises a machine screw which moves the means for premetering towards the substrate.

16. The apparatus of claim 9 wherein each means for profiling in the cross machine direction comprises a expansible rod positioned beneath the means for premetering.

17. A coating applicator for applying a coating to a moving substrate, the applicator comprising:

a short dwell coater head housing positioned beneath the moving substrate and opening toward the substrate, the housing extending in a cross machine direction;

an upstream baffle plate, mounted on the short dwell coater head housing which extends from the housing toward the substrate;

a premetering member which is mounted to the short dwell coater head housing downstream of the baffle plate, the premetering member defining a coating application chamber between the substrate and the baffle plate, and wherein the premetering member extends toward the substrate to define a converging region of the coating application chamber, and wherein the coating application chamber receives an inflow of coating, a portion of which overflows the upstream baffle plate;

a coating supply passageway between the upstream baffle plate and the premetering member for supplying coating to the coating application chamber;

an inflatable pneumatic tube engaged with the premetering member to urge the premetering member against the substrate;

a final metering blade downstream of the premetering member which extends form the short dwell coater head housing toward the substrate;

a plurality of controllable actuators positioned beneath the pneumatic tube, and mounted on the short dwell coater head housing, the plurality of controllable actuators arranged in a series spaced from each other in the cross machine direction, each actuator being controllable to engage against the pneumatic tube beneath the premetering member and to displace a portion of the premetering member to bring it into closer proximity to the substrate; and a controller operatively connected to each of the plurality of controllable actuators.

18. The apparatus of claim 17 wherein the premetering member comprises a movable wedge supported for motion toward the substrate on the inflatable pneumatic tube.

19. The apparatus of claim 17 wherein the premetering member comprises:

a cylindrical rod engaged with the substrate; and a rod holder in which the cylindrical rod is supported for rotation, the rod holder being mounted on the inflatable pneumatic tube for motion toward the substrate.

20. The apparatus of claim 17 wherein the premetering member comprises a blade oriented substantially tangent to the substrate and engaging the substrate at a line of tangency, the blade being urged against the substrate by the inflatable tube.

21. The apparatus of claim 17 wherein each controllable actuator is controllable independently of the other actuators.

22. The apparatus of claim 17 wherein each controllable actuator comprises a rotatable machine screw arrangement.

23. The apparatus of claim 17 wherein each controllable actuator comprises a thermally expansible rod positioned beneath the pneumatic tube and premetering member and engageable therewith.

* * * * *